United States Patent [19]

Rogers

[11] Patent Number: 4,797,090

[45] Date of Patent: Jan. 10, 1989

[54] CANDLE LANTERN APPARATUS

[76] Inventor: H. Gardner Rogers, 20 Newton St., Weston, Mass. 02193

[21] Appl. No.: 62,164

[22] Filed: Jun. 12, 1987

[51] Int. Cl.[4] ..... F23D 3/16

[52] U.S. Cl. ..... 431/290; 431/288; 431/289; 431/253; 431/126; 446/457; 362/161; 362/163; D26/6

[58] Field of Search ..... 431/288, 289, 290, 253, 431/126; 102/359, 355, 356; 222/200; 446/457; 362/161, 163; D26/6

[56] References Cited

U.S. PATENT DOCUMENTS

| | | | |
|---|---|---|---|
| 114,772 | 5/1871 | Dare | 431/290 |
| D. 244,056 | 4/1977 | Jimenez et al. | D26/6 |
| 395,574 | 1/1889 | Martin | 431/290 |
| 3,730,674 | 5/1973 | Gross | 431/288 |
| 3,754,861 | 8/1973 | Sadahiro | 431/289 X |

FOREIGN PATENT DOCUMENTS

| | | | |
|---|---|---|---|
| 2822426 | 12/1979 | Fed. Rep. of Germany | 431/288 |
| 3431018 | 3/1986 | Fed. Rep. of Germany | 431/289 |
| 348582 | 4/1905 | France | 431/289 |
| 353090 | 7/1931 | United Kingdom | 102/359 |
| 389249 | 3/1933 | United Kingdom | 102/359 |

*Primary Examiner*—Samuel Scott
*Assistant Examiner*—Carl D. Price
*Attorney, Agent, or Firm*—Lahive & Cockfield

[57] ABSTRACT

This invention relates to candles. It provides a candle and base structure that allows a candle to maintain the candle flame at substantially the same elevation as the candle burns. The invention further provides a candle lantern and a movable base for a candle lantern.

19 Claims, 3 Drawing Sheets

CANDLE LANTERN APPARATUS

BACKGROUND

This invention relates to candles. It provides a novel candle structure that maintains the candle flame at substantially the same elevation as the candle burns, and by the action of the candle itself. The invention further provides a novel candle lantern and a novel base for a candle lantern.

Candles typically stand erect and the duration of burning of a conventional candle is generally limited by the height of the candle. The rate of burning of a candle includes factors such as the cross-sectional dimensions of the candle and the type of wax employed, including any hardening agents.

The direct relationship between the height of a candle and the duration of burning becomes a significant limitation in the utilization of candles in applications affording limited vertical space. One instance where this limitation arises, for example, is in a Halloween Jack-O-Lantern.

Further. as a conventional candle burns, the location of the flame descends. This change in flame elevation can be disadvantageous, either aesthetically or functionally or both.

The prior art of candle lamps includes U.S. Pat. No. 395,574 of Martin which discloses an accurately shaped candle which a spring mechanism advances as the candle burns, and which thereby maintains the flame at a constant elevation. U.S. Pat. No. 3,730,674 of Gross discloses a variety of candle configurations which employ a wick that is termed as having a memory for providing self movement of the wick, relative to the body of wax, during burning of the candle.

It is an object of this invention to provide an improved candle which maintains the flame at a substantially constant elevation during burning. A more particular object is to provide a candle which burns at a substantially constant vertical position relative to the candle base by the action of the candle itself. Another object of the invention is to provide a candle lantern which affords extended burning duration, and yet which is of compact dimensions.

It is also an object of the invention to provide a base for a candle of the above character in which the candle flame remains at a substantially uniform vertical location.

It is also an object of the invention to provide a novel candle and novel candle lantern which are characterized by being aesthetically attractive and having unique functional features.

Other objects of the invention will in part be obvious and will in part be set forth below.

SUMMARY OF THE INVENTION

A candle lantern according to the invention includes a candle having a spiral shape, together with a candle holder which mounts the candle for revolving about a substantially horizontal axis. The outer end of the mounted spiral candle extends substantially vertically downward from the outer spiral end. As the candle burns at the outer spiral end and is consumed, the candle revolves due to the force of gravity to maintain the candle flame at an essentially uniform elevation relative to the axis of revolution. More particularly, the candle rotates so that the center of gravity is maintained below the axis of revolution, substantially on a vertical axis passing through the horizontal axis of revolution.

Candle apparatus according to the invention accordingly includes a body of candle wax that is elongated along a substantially spiral path from an inner end to an outer end. The candle body is arranged for mounting, typically at the inner end, for revolving about a substantially horizontal axis as located substantially at the spiral origin. The body of candle wax extends substantially vertically downward from the candle outer end. The candle has a wick extending within the body of candle wax from the outer end and conforming substantially with a spiral path.

In a preferred embodiment, the candle body has a selected taper to dispose the candle flame at the spiral outer end at a selected elevation relative to the axis of revolution. One preferred taper of the candle wax body maintains a greater portion of the candle weight on the side of the revolution axis opposite the flame, to elevate the candle flame relative to the revolution axis.

A further preferred feature of the practice of the invention provides a candle holder element which forms substantially the inner portion of the spiral path of the candle. One preferred form of this feature provides a candle holder that forms substantially the inner three-quarters of the first turn of the spiral candle path. This candle holder, together with the candle, maintains the candle lantern properly balanced even when the candle is nearly entirely consumed.

A further preferred element of a candle lantern according to the invention is a base element which mounts the spiral candle for revolution about the substantially horizontally axis substantially at the origin of the spiral path. The candle preferably conforms with a spiral having constant radial spacing between turns, e.g. with an involute of a circle.

A candle lantern according to the invention further can employ a lantern chimney which is seated with the candle holder or other base structure for receiving at least the outer flame end of the spiral candle. In one embodiment, the entire spiral candle is within the chimney. Another embodiment includes a carriage mechanism which mounts the spiral candle relative to the chimney in such a way as to move the candle horizontally relative to the chimney and maintain the candle outer end substantially stationary relative to the chimney as the candle burns. The carriage assembly employs the gravitational rotation of the spiral candle, as it burns, to move the spiral candle horizontally in a manner to compensate for the decreasing radius of the burning candle and thereby to maintain the burning end of the candle substantially centered or otherwise relatively stationary within the chimney.

The invention is further described below in connection with certain illustrated embodiments. However, various changes, modifications and additions may be made in the practice of the invention are those skilled in the art without departing from the scope of the invention as defined in the claims.

BRIEF DESCRIPTION OF THE DRAWINGS

For a fuller understanding of the nature and objects of the invention, reference should be made to the following detailed description and the accompanying drawings in which.

DESCRIPTION OF ILLUSTRATED EMBODIMENTS

Figure 1B:
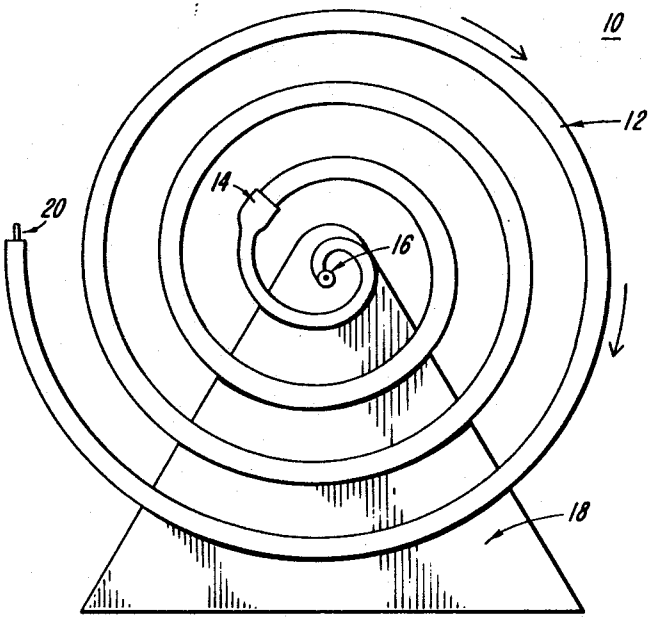
FIG. 1B is a front view of a candle lantern according to the invention, giving detail of a holder element.
Figure 1A:
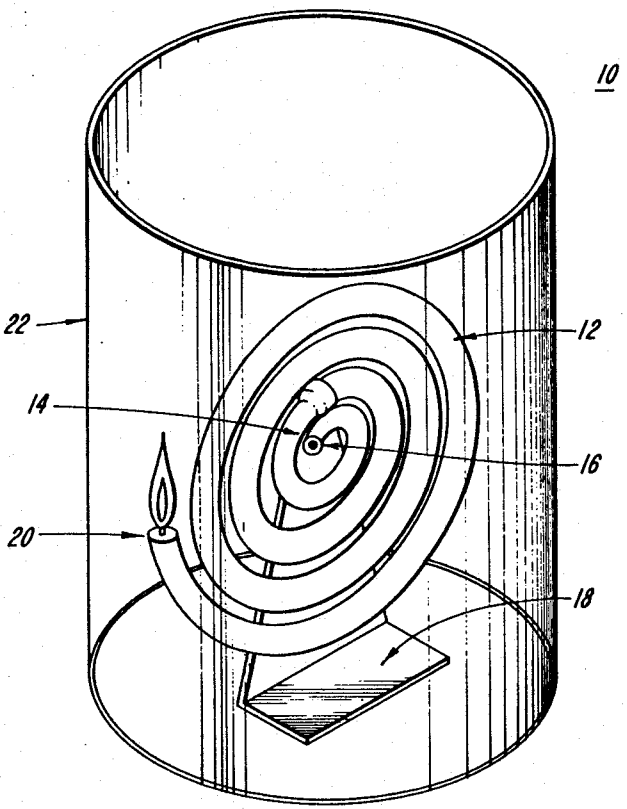
FIG. 1A is a perspective view of a spiral candle lantern according to the invention.

Referring to FIG. 1A, a spiral candle lantern 10 includes a spiral candle element 12, candle holder element 14, a hinge pin 16, and base element 18. Candle holder element 14 rotatably connects the candle 12 to the base element 18 by way of the pivot pin 16. Pivot pin 16 allows candle element 12 to rotate n $\times 360°$ in a substantially vertical plane with respect to base element 18, where n is a positive number. In a preferred embodiment of the invention, the outer end of candle element 12 is enclosed within a chimney 22, which may be constructed of glass or other suitable material.

Candle element 12, as illustrated in FIG. 1A, has a generally spiral shape, and is generally a rod having a circular, elliptical, or other cross section. In a preferred embodiment of the invention, the shape of the candle element 12 conforms to an involute of a circle. The involute of a circle is described by the following equations:

$$X = \cos t + t \sin t$$

$$Y = \sin t - t \cos t$$

where X, Y and t are horizontal, vertical, and angular coordinates, respectively.

Candle 12 is mounted on pivot pin 16, and the outer end 20 of candle 12 extends substantially vertically. As a flame burns at the outer end of candle 12, candle 12 is gradually consumed. As each incremental portion of the candle 12 is consumed, the moment of force on the left side of pivot point 16 is reduced. Gravity pulls downward the portion of the candle 12 to the right of the pivot point 16, until the moments, i.e. the products of weight times moment arm, to the left and to the right of the pivot 16 are in equilibrium. More particularly, the candle 12 rotates so that the center of gravity is maintained below the axis of revolution, substantially on a vertical axis passing through the horizontal axis of rotation defined by pivot pin 16. Thus, the force of gravity causes candle 12 to rotate clockwise, as indicated in FIG. 1B.

The center of gravity of the candle 12 is maintained beneath the pivot 16, substantially on a vertical axis passing through the pivot 16. Consequently, outer end 20 remains at a substantially constant height relative to the pivot 16. The burning end of candle 12 is also maintained at a substantially vertical attitude, regardless of small inclinations of the base 18. In a preferred embodiment of the invention, in order to maintain balance, the pivot point 16 coincides with the center or origin of the spiral of the candle 12, or if a holder element 14 is utilized, with the origin of the holder element 14.

Preferably, the holder element 14 is of the same density and shape as the candle 12, forming a continuation of the spiral shape of the candle 12. A typical specific gravity for the candle 12 is approximately 0.9, and a preferred material for the holder 14 is aluminum alloy. If the density of the candle 12 is not equal to that of the holder 14, the dimensions of the holder may be adjusted so that the product of the weight times moment arm is the same to the left and to the right of pivot 16.

In a further preferred embodiment, the candle holder element 14 comprises the first three-quarter turn of the spiral, with the origin of the spiral of holder 14 coinciding with pivot 16, holding the inner end of the candle 12 offset from the pivot point 16. In this configuration, counterweight is retained in three of four quadrants even when the candle element 12 is completely consumed, thus maintaining stability.

In another embodiment of the invention, the force of gravity is used to feed successive portions of the candle 12 through a chimney which covers only the outer end 20 of candle element 12, while the vertical location of the outer end 20 in the chimney remains substantially constant. In order to maintain a constant height of the outer end 20 in the chimney 22, the diameter of the candle element 12 is preferably tapered, so that as each incremental portion of the candle 12 is consumed, a greater portion of the candle element mass is maintained at the candle portions opposite the flame, so that a counterweight is maintained and an equilibrium of moment on either side of the pivot 16 is achieved when the outer end 20 is approximately at the same height as the pivot point 16.

A variety of methods may be utilized in a preferred practice of the invention to form the spiral shaped candle 12. The candle 12 may be formed in a spiral mold, or, in a preferred practice, a prefabricated candle may be shaped under heat into the desired spiral shape.

Figure 2A:
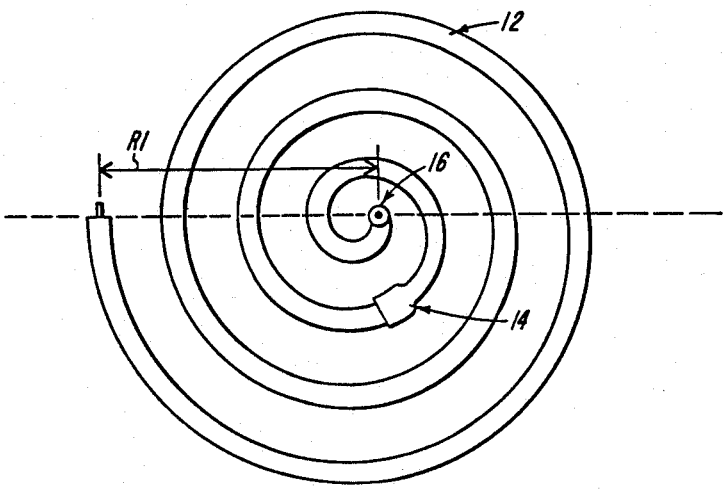
FIG. 2A is a front view of a candle lantern according to the invention, showing an initial state of the candle element.
Figure 2B:
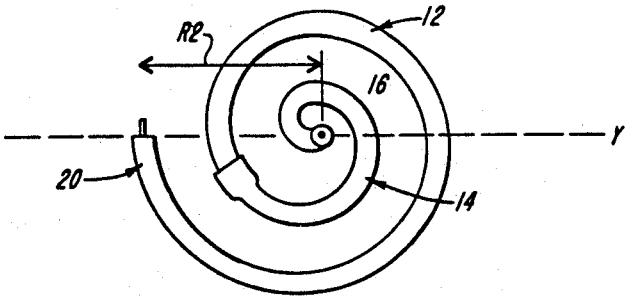
FIG. 2B is a front view of a candle lantern according to the invention, showing a partially consumed candle element.

It will be understood from the foregoing that the spiral shape of the rotatably mounted candle 12 maintains the flame 20 at a constant height with respect to the pivot point 16. However, as the candle 12 is consumed, the radius of the remaining outermost portion of the candle 12 decreases. Thus, as illustrated in FIGS. 2A and 2B, as the candle 12 is consumed and rotates clockwise, the distance from the outer end 20 of candle 12 to pivot point 16 decreases. FIG. 2A illustrates the initial distance R1, measured at position Y, between the outer end 20 and pivot point 16. FIG. 2B illustrates a partially consumed candle 12, in which R2 represents the reduced distance from outer end 20 to pivot point 16.

Figure 3A:
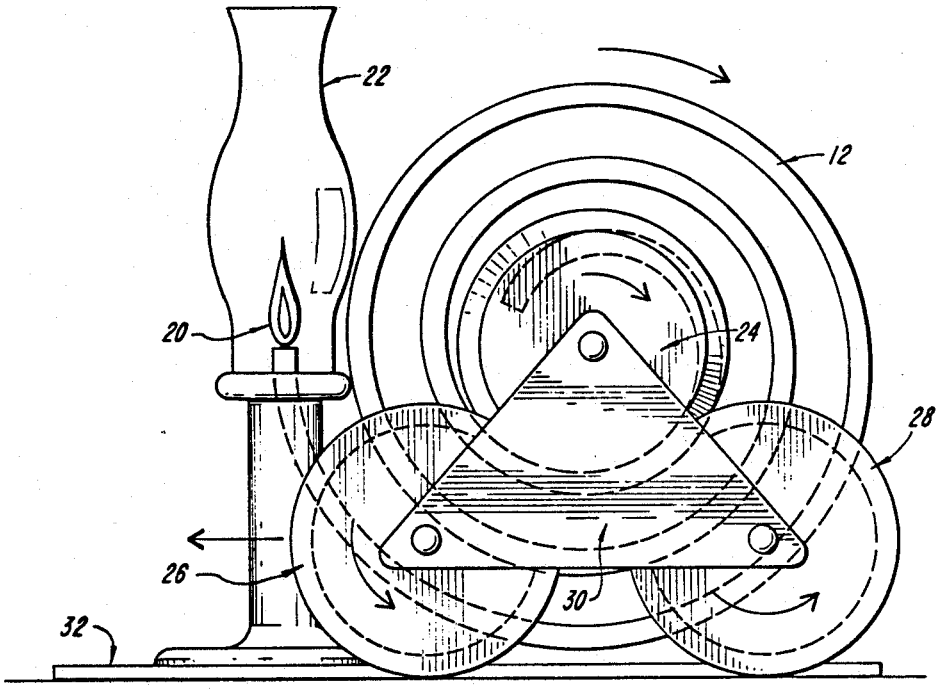
FIG. 3A is a front view of a carriage assemblage utilized in conjunction with the candle lantern of FIG. 1.
Figure 3B:
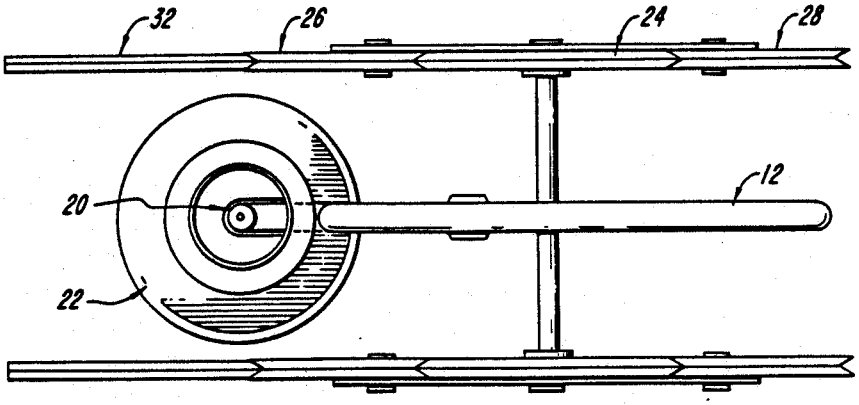
FIG. 3B is a top view of the carriage assemblage of FIG. 3A.

FIG. 3A illustrates a carriage assembly which utilizes the rotation of the candle 12 to compensate for the decreasing radius of the candle 12, maintaining the outer end 20 in the center of the chimney 22. Wheel 24, affixed to the candle 12, engages wheels 26 and 28, which are held in fixed alignment with one another by bracket 30. Wheels 26 and 28, in turn, engage track 32. This configuration is further illustrated in FIG. 3B, which indicates how candle 12 enters chimney 22 through a slot in chimney 22.

As the candle 12 rotates clockwise, as indicated in FIG. 3A, wheel 24 also rotates clockwise. The clockwise rotation of wheel 24 causes wheels 26 and 28 to rotate counter-clockwise, and, in turn, causes the carriage mechanism supporting the candle 12 to translate to the left. The respective radii of wheel 24 and wheels 26 and 28 are selected so as to yield a translation component which compensates for the decreasing radius of the spiral form of the candle 12 as it is consumed. In other embodiments of the invention, the carriage assembly can be utilized to longitudinally move chimney 22 with respect to base element 18.

It will thus be seen that the invention efficiently attains the objects set forth above. In particular, the invention provides an improved candle apparatus which maintains the flame at a substantially constant elevation during burning, by action of the candle itself. The invention also provides a candle lantern which affords extended burning duration, and which is aesthetically attractive.

It will be understood that changes may be made in the above constructions without departing from the scope of the invention. It is accordingly intended that all matter contained in the above description or shown in the accompanying drawings be interpreted as illustrative rather than in a limiting sense.

It is also to be understood that the following claims are intended to cover all the generic and specific features of the invention as described herein, and all statements of the scope of the invention which, as a matter of language, might be said to fall therebetween.

Having described the invention, what is claimed as new and secured by Letters Patent is:

1. A candle apparatus, comprising candle means, including a spiral candle element, for providing a flame at a first burning end of said element, base means for supporting said candle means, and hinge means rotatably connected between said candle means and said base means for supporting said candle means in a substantially vertical plane, for rotation of said candle means with respect to said base means under the influence of gravity, so that as said first end burns, said candle means rotates due to the influence of gravity and said flame remains at a substantially constant angular relationship with respect to said base means.

2. A candle apparatus according to claim 1, wherein said hinge means comprises a hinge pin passing through an associated orifice in said base means, and candle holder means affixed to said candle means and having an orifice through which said hinge pin passes, so that said candle holder means is rotatably mounted to said base means.

3. A candle apparatus according to claim 2, wherein said spiral candle element has a diameter selectively tapered over substantially the entire length of said candle element for providing selected gravitational balance of said candle means about said hinge means.

4. A candle apparatus according to claim 3, wherein said hinge pin is located approximately at the origin of said spiral defined by said candle.

5. A candle apparatus for use in a base, comprising candle means, including an involute spiral candle element having a first outer burning end, said involute spiral candle element having inner end support means (i) for supporting said candle element in a substantially vertical orientation and (ii) for automatically, due to the influence of gravity, maintaining said first outer burning end of said candle element substantially upright as said candle element burns.

6. A base apparatus for a candle, comprising holder means for affixing to the candle substantially at the gravitational center of the candle and for holding the candle in a substantially vertical plane, base means for supporting said holder means, and hinge means, interposed between said base means and said holder means, for permitting the candle held by the holder means to rotate automatically, as the candle burns, due to the influence of gravity about a substantially horizontal axis passing substantially through the gravitational center of the candle, said rotation being with respect to said base means.

7. A candle apparatus comprising:

candle means, including a spiral candle element, for providing a flame at a first burning end of said element, base means for supporting said candle means, hinge means rotatably connected between said candle means and said base means for supporting said candle means for rotation with respect to said base means under the influence of gravity, so that as said first end burns, said candle means rotates under the influence of gravity and said flame remains at a substantially constant height with respect to said base means, and carriage means, connected between said hinge means and said base means, for converting rotational motion of said candle means to linear motion of said hinge means, for maintaining said first end of said candle at a substantially constant horizontal position with respect to said base means as said first end burns.

8. Candle apparatus comprising a solid body of candle wax elongated along a substantially spiral path, having a spiral origin, from an inner end to an outer end, said candle body being arranged for mounting adjacent said inner end for revolving automatically, as the candle burns, due to the influence of gravity about a substantially horizontal axis located substantially at the spiral origin and with the body of candle wax extending substantially vertically downward at the candle outer end, and a candle wick extending within said body of candle wax from said outer end and conforming substantially with said spiral path.

9. Candle apparatus comprising a solid body of candle wax elongated along a substantially spiral path from an inner end to an outer end, arranged for mounting adjacent said inner end for revolving under the influence of gravity about a substantially horizontal axis located substantially at the spiral origin and with the body of candle wax extending substantially vertically downward at the candle outer end, said candle body having a selected taper for disposing said candle outer end at a selected elevation relative to said axis of revolution under the influence of gravity, and a candle wick extending within said body of candle wax from said outer end and conforming substantially with said spiral path.

10. Candle apparatus comprising a solid body of candle wax elongated along a substantially spiral path, having a spiral origin, from an inner end to an outer end, means for mounting said body of candle wax, at said inner end thereof, for revolving, as the candle burns, due to the influence of gravity about a substantially horizontal axis located substantially at the spiral origin and with the body of candle wax extending substantially vertically downward at the candle outer end, said mounting means and said candle body mounted therewith extending along said spiral path for at least one spiral revolution, and a candle wick extending within said body of candle wax from said outer end and conforming substantially with said spiral path.

11. Candle apparatus comprising a solid body of candle wax elongated along a substantially spiral path from an inner end to an outer end, arranged for mounting adjacent said inner end for revolving under the influence of gravity about a substantially horizontal axis located substantially at the spiral origin and with the body of candle wax extending substantially vertically downward from the candle outer end, a candle wick extending within said body of candle wax from said outer end and conforming substantially with said spiral path, and means for removably and replaceably mounting said body of candle wax at said inner end for revolution of said body of candle wax about said axis, said mounting means providing substantially three-quarters of the first revolution of said spiral path from the origin thereof.

12. Candle apparatus comprising a solid body of candle wax elongated along a substantially spiral path from an inner end to an outer end, arranged for mounting adjacent said inner end for automatically revolving, as the candle burns, due to the influence of gravity about a substantially horizontal axis located substantially at the spiral origin and with the body of candle wax extending substantially vertically downward from the candle outer end, and a candle wick extending within said body of candle wax from said outer end and conforming substantially with said spiral path, wherein said body of wax and said wick both extend along an involute of a circle path.

13. Candle lantern apparatus comprising a candle having a wick within a body of wax elongated along a substantially spiral path and having an inner end and an outer end, and base means for mounting said candle with said spiral path thereof being oriented in a substantially vertical plane and for rotation about a substantially horizontal axis substantially at the origin of said spiral path and with said body of wax extending downward at said outer end, for disposing said wick substantially vertically at said outer end, and wherein said candle is automatically rotatable due to the influence of gravity relative to said base means as said candle burns.

14. Candle lantern apparatus according to claim 13 in which said spiral path is essentially that of an involute of a circle.

15. Candle lantern apparatus comprising a candle having a wick within a body of wax elongated along a substantially spiral path and having an inner end and an outer end, and base means for mounting said candle for revolution about a substantially horizontal axis substantially at the origin of said spiral path and with said body of wax extending downward at said outer end, for disposing said wick substantially vertically at said outer end, said base means including candle holder means mounted for said revolution and for supportingly mounting said candle, said holder means and said candle mounted therewith extending inward along said spiral path from the candle outer end for at least three-quarters of a spiral revolution.

16. Candle lantern apparatus comprising a candle having a wick within a body of wax elongated along a substantially spiral path and having an inner end and an outer end, base means for mounting said candle for revolution about a substantially horizontal axis substantially at the origin of said spiral path and with said body of wax extending downward at said outer end, for disposing said wick substantially vertically at said outer end, and lantern chimney means seated with said base means for receiving said candle outer end therein.

17. Candle lantern apparatus according to claim 16 in which said chimney means is arranged for receiving therein the length of said candle between said outer and inner ends thereof.

18. Candle lantern apparatus according to claim 16, in which said base means further comprises carriage means for moving said candle horizontally relative to said chimney means for maintaining said candle outer end substantially stationary horizontally relative to said chimney means during burning of said candle.

19. Candle lantern apparatus according to claim 18, wherein said carriage means includes first driven wheel means, coupled to said candle and rotatably mounted to said base means, for receiving rotational motion from said candle, and second driven wheel means for engaging said first driven wheel means and for engaging a given planar surface, so that rotational motion of said candle is converted into horizontal motion of said base means relative to said chimney means.

* * * * *